US005370323A

United States Patent [19]

Narao

[11] Patent Number: 5,370,323

[45] Date of Patent: * Dec. 6, 1994

[54] WASTE DISPOSER

[75] Inventor: Shinya Narao, Tottori, Japan

[73] Assignee: Kabushiki Kaisha Nissei Giken, Tottori, Japan

[ * ] Notice: The portion of the term of this patent subsequent to Jul. 14, 2009 has been disclaimed.

[21] Appl. No.: 82,046

[22] Filed: Jun. 24, 1993

[51] Int. Cl.[5] ..... B02C 23/36

[52] U.S. Cl. ..... 241/46.013; 100/117; 210/174; 210/415; 241/46.017; 241/100; 241/101.2

[58] Field of Search ..... 241/46.01, 46.02–46.017, 241/100, 101.2, 46.013; 210/173, 174, 415; 100/935, 94, 117

[56] References Cited

U.S. PATENT DOCUMENTS

| | | | |
|---|---|---|---|
| 1,703,535 | 2/1929 | Mannung | 210/173 X |
| 3,188,942 | 6/1965 | Wandel | 100/117 X |
| 3,247,970 | 4/1966 | Jellesma | 210/174 |
| 3,527,158 | 9/1970 | Young | 100/117 |
| 4,337,901 | 7/1982 | Ogura | 241/100 |
| 5,129,590 | 7/1992 | Shinya | 241/46.017 X |

FOREIGN PATENT DOCUMENTS

| | | | |
|---|---|---|---|
| 793823 | 9/1968 | Canada | 210/174 |
| 3258656 | 10/1988 | Japan | 210/173 |

*Primary Examiner*—Mark Rosenbaum
*Assistant Examiner*—Frances Han
*Attorney, Agent, or Firm*—Wolf, Greenfield & Sacks

[57] ABSTRACT

A waste disposer comprises a shredder section for shredding waste material and a water remover section coupled integrally with the shredder section for removing water from the waste material, in which the shredded waste material is carried upward throughout a cylindrical screen member mounted in the water remover section by the rotation of a screw while its containing water being removed and drained through apertures of the screen member. A plurality of vertically extending rib portions are arranged at equal intervals on the inner wall of the screen member so that screw blade comes in direct contact with the rib portions during its rotation. A plurality of pins are provided at equal intervals on the outer edge of the screw blade, each pin having a length sufficient to run directly on the inner wall of the screen member as the screw rotates.

2 Claims, 4 Drawing Sheets

WASTE DISPOSER

TECHNICAL FIELD

The present invention relates to a waste disposer for grinding and removing raw waste material created in a kitchen.

BACKGROUND ART

Waste disposers are commonly used for grinding and removing raw waste material produced in kitchens, each comprising a shredder for shredding the waste material and a water remover for removing water from the shredded waste material which both are assembled in a unit.

More specifically, such a traditional waster disposer comprises a shredder section communicating to a drain outlet of a kitchen sink and a water remover section for removing water from the shredded waste material. In action, raw material is fed into the shredder section of the disposer where it is shredded with a supply of water and the shredded waste material is transferred into a cylindrical screen member of the water remover section where it is carried upward by means of rotation of a screw blade while its containing water being removed through apertures of the screen member. After the removal of water, the shredded waste material with a minimum of water is disposed from the uppermost of the screen member into a waste container.

However, The traditional waste disposer permits the shredded waste material to be carried upwards throughout the screen member by the rotation of the screw while being pressed against and turned in a circle along the inner wall of the screen member, and thus discharged out from the upper end of the screen member in the form of masses which contain a considerable amount of water. Hence, when such masses of the shredded waste material are stored in the waste container, they become rotten easily generating odor. Also, the shredded waste material turns in the screen member as the screw rotates and will thus be carried upward with less efficiency.

Furthermore, sticky portions of the shredded waste material tend to stay between the screw and the lower inner wall of the screen member disturbing the flow of water and discouraging the smooth action of the waste disposer.

DISCLOSURE OF THE INVENTION

As defined in claim 1, an object of the present invention is to provide an improved waste disposer which comprises a shredder section communicated with a drain hole of a sink in a kitchen for shredding waste material and a water remover section coupled integrally with the shredder section for removing water from the waste material, in which the waste material is fed together with a supply of water into and shredded with the shredder section, and the shredded waste material is carried upward throughout a cylindrical screen member mounted in the water remover section by the rotation of a blade of a screw provided in the screen member while its containing water being removed and drained through apertures of the screen member before discharged from the upper end of the screen member, and is characterized in that a plurality of rib portions of a given width projecting inward and extending vertically from the upper end to a central region of the screen member are arranged at equal intervals on the inner wall of the screen member so that the screw blade comes in direct contact with the rib portions during its rotation.

As defined in claim 2, a similar waste disposer is characterized in that a plurality of pins of a hard material are provided at equal intervals on the outer edge of a lower region, from the lowermost to a central, of the screw blade, each pin having a length sufficient to run directly on the inner wall of the screen member as the screw rotates.

In action, the shredded waste material containing a fair amount of water and transferred to the lower end of the screen member of the water remover section is prevented its rotating movement by the rib portions arranged on the inner wall of the screen member and thus compressed with a succeeding volume of the shredded waste material. Hence, while it is being carried upward along the rib portions, the shredded waste water releases its containing water. The released water is discharged through the apertures of the screen member into a casing provided in the outside of the screen member for drainage. The shredded waste material with a minimum of water is removed from the upper opening of the screen member to a waste container for disposal.

Also, the hard pins provided on the outer edge of the screw blade scrape off sticky portions of the shredded waste material from the inner wall of the screen member allowing the flow of waste water to drain through the apertures of the screen member.

BEST MODE FOR CARRYING OUT THE INVENTION

A preferred embodiment of the present invention will be described in the form of a waste disposer referring to the accompanying drawings.

Figure 1:
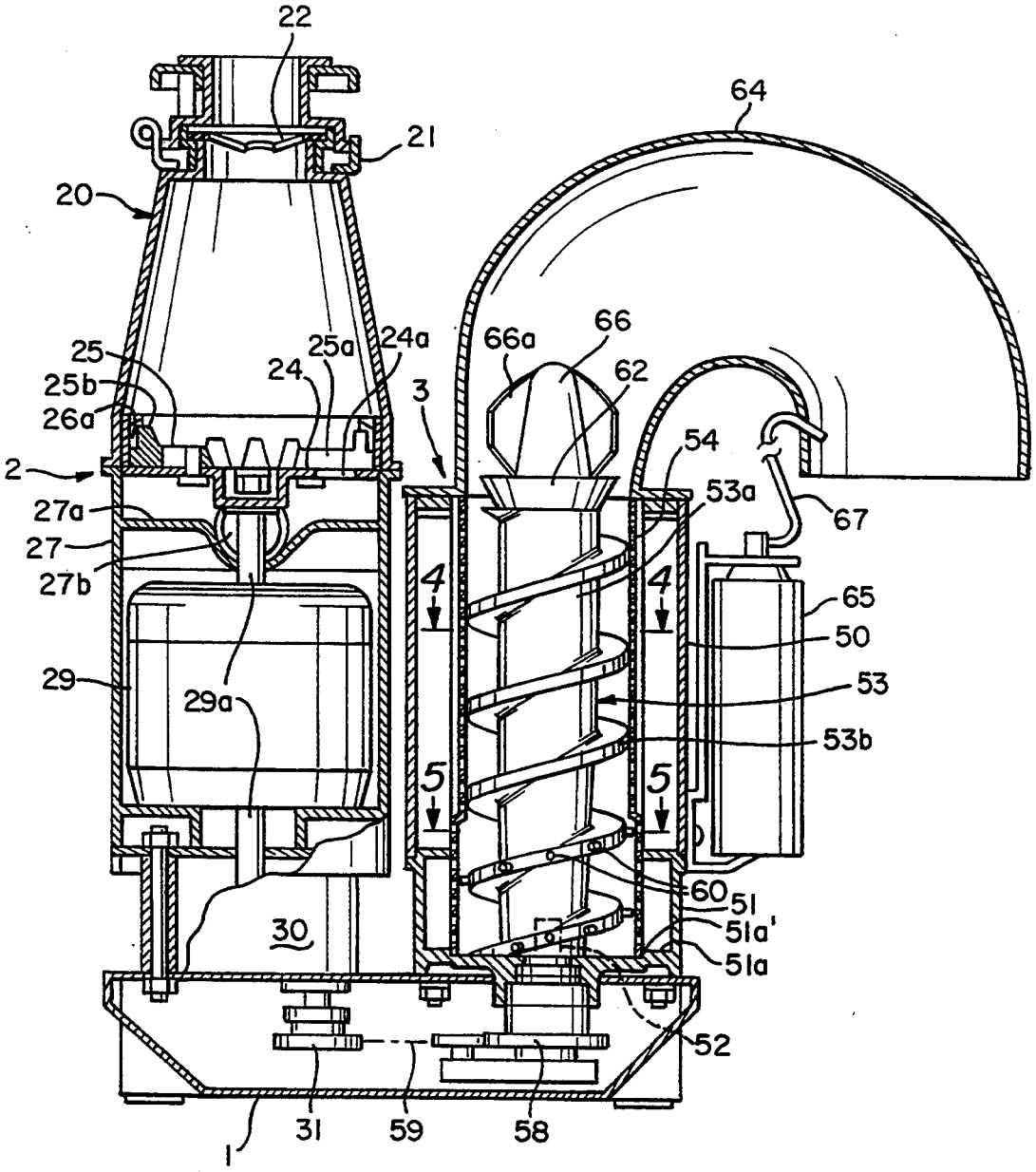
FIG. 1 is a longitudinally cross sectional view of a waste disposer according to the present invention.
Figure 2:
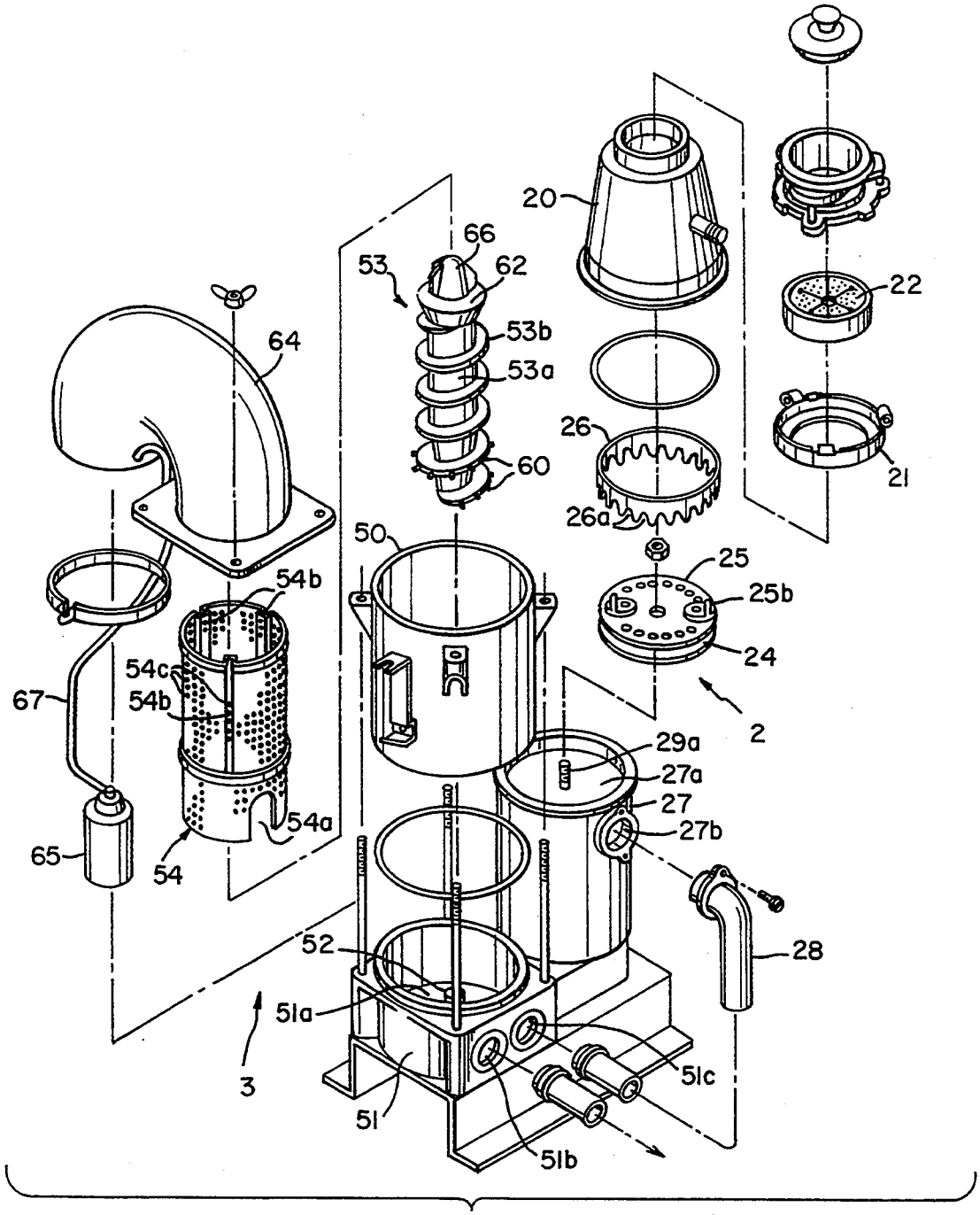
FIG. 2 is an exploded perspective view of the same.

As shown in FIGS. 1 and 2, the waste disposer according to the present invention comprises a shredder section 2 supported on a base 1 and a water remover section 3 for removing water from raw waste material.

The shredder section 2 includes a waste feeding cylinder 20 provided in the upper thereof and coupled at top to a receiver ring 21. The receiver ring 21 contains a guard member 22 of rubber material which has radially extending slits in the center for preventing escape of waste material and water from the disposer during shredding operation.

The waster feeding cylinder 20 has a shredder ring 26 mounted to the inner wall of a lower opening thereof. The shredder ring 26 has notches **26*a* arranged at lower end thereof and accommodates a pair of shredder members 24 and 25 formed of a substantially oval shape in plan elevation. The shredder members 24 and 25 have numbers of apertures 24*a* and 25*a* therein and are fixedly mounted to the drive shaft 29*a* of a motor 29. The shredder member 25 has a plurality of upwardly projecting shredder blades 25b** mounted on the upper surface edge thereof for shredding the waste material.

The waste feeding cylinder 20 is integrally coupled at lowermost to the upper end of a main cylinder 27 having a bottom plate 27a for receiving the shredded waste material. The main cylinder 27 also has an outlet opening 27b provided above its bottom plate 27a for transferring the shredded waste material into the water remover section 3. The outlet opening 27b is communicated to one end of a conduit 28 which extends to an inlet opening 51c of a casing 51 of the water remover section 3 which will be described later.

The main cylinder 20 contains the motor 29 mounted beneath the bottom plate 27a. The drive shaft 29a of the motor 29 upwardly extends through the center of the bottom plate 27a into the interior of the shredder ring 26. The drive shaft 29a having the shredder member 25 threaded onto the uppermost end thereof is coupled at lowermost end to a shift gear case 30 for driving a chain sprocket 31 (or pulley) which extends into the base 1. The shift gear case 30 may be driven by another motor different from the motor 29 of the shredder section.

The water remover section 3 of the waste disposer includes the casing 51 which has a bottom 51a and is formed of a cylindrical shape. The casing 51 is mounted next to the motor 29 on the base 1 to support a cylindrical housing 50 with the upper end of its wall extending from the bottom 51a. The casing 51 has a drain outlet 51b provided therein adjacent to the waste material inlet opening 51a for discharging the water removed from the waste material. The bottom 51a of the casing 51 has a drive shaft 52 supported in the center thereof to be driven by the rotation of the motor 29. Also, the bottom 51a of the casing 51 has a stepdown region 51a' in the center to support a cylindrical screen member 54 which extends upward to accommodate a screw 53 described later.

The lowermost end of the drive shaft 52 extends downward through the bottom 51a of the casing 51 and is coupled to a chain sprocket 58 (or pulley) which is linked by a chain 59 (or V-belt) to the chain sprocket 31.

Figure 3:
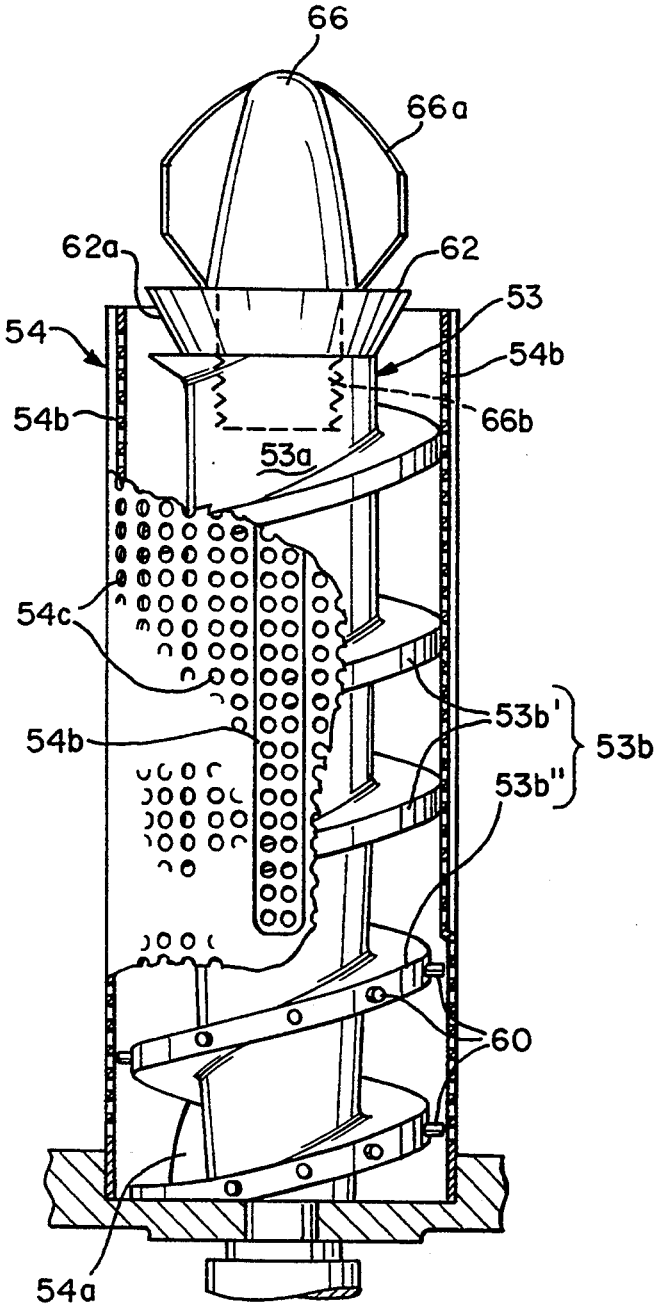
FIG. 3 is a side cross sectional view of a screen member accommodating a screw.
Figure 4:
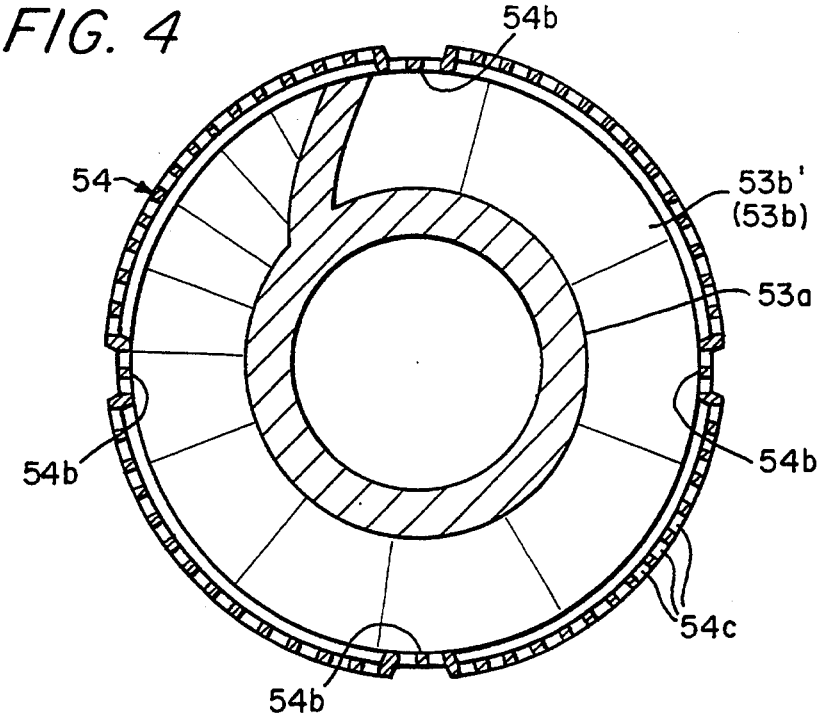
FIG. 4 is a cross sectional view taken along the line A—A of FIG. 1.
Figure 5:
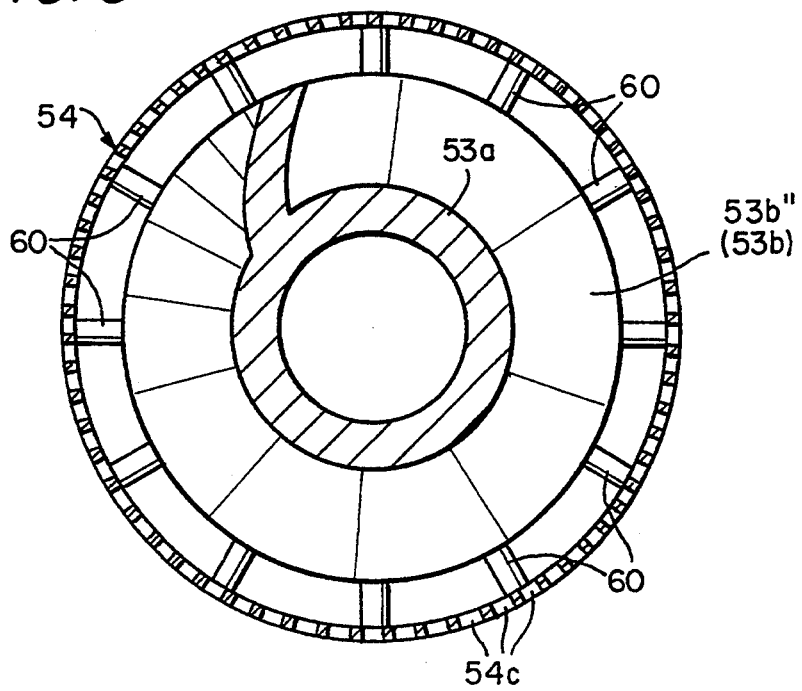
FIG. 5 is a cross sectional view taken along the line B—B of FIG. 1.

As shown in FIGS. 1 to 3, the screw 53 includes a body 53a and a spiral blade 53b extending lengthwisely and projecting outwardly of the body 53a. The spiral blade 53b includes an upper region 53b' having a diameter almost equal to the inner diameter of the screen member 54 and a lower region 53b'' having a plurality of metal pins 60 arranged at equal intervals on the outer edge surface of the lower region 53b'' for scraping off waste material from the inner wall of the screen member 54.

The screen member 54 has a multiplicity of apertures 54c provided in the entire wall thereof for discharging the water removed from the waste material, as illustrated in FIGS. 1 to 5. The lowermost end of the screen member 54 is provided with an opening 54a therein for feeding the waste material from the shredder section 2. Also, the screen member 54 has rib portions 54b of about 1 cm in width arranged on the inner wall thereof to project inward and extend vertically from the uppermost end to a central region of the screen member 54. The apertures 54c are also provided throughout the rib portions 54b. Accordingly, the upper region 53b' of the spiral blade 53b can travel directly on the rib portions 54b while the lower region 53b'' travels with its pins 60 directly running on a lower region of the inner wall of the screen member 54 where the rib portions 54b are not provided during the rotation of the screw 53.

A screw cap 66 is threaded with its stud portion 66b into the upper opening of the screw 53. The screw cap 66 has agitator blades 66a arranged on the side wall thereof for agitating the shredded waste material.

In particular, an annular projecting reflector 62 is fixedly fitted onto the stud portion 66b of the screw cap 56 for guiding and squeezing the shredded waste material. The projecting reflector 62 is formed into an inverted truncated cone with a through opening in the center which has a slope 62a on the outer side thereof tapering towards the lowermost. The uppermost of the projection reflector 62 extends outwardly slightly from the upper opening of the screen member 54 so that the distance between the projection reflector 62 and the inner wall of the screen member 54 is smaller in the upper than in the lower.

As shown in FIG. 1, the upper end of the screen member 54 is coupled to a waste discharging conduit 64 which is identical in the diameter to the screen member 54 and has an arcuate shape sloping from upper to lower. Preferably, a deodorant container 65 is mounted on the side of the housing 50 and has its top outlet coupled to a vinyl tube 67 which extends to an exit portion of the discharging conduit 64.

The process of shredding and disposing raw waste material in the waste disposer will now be explained in a sequence of steps.

The waste material from a kitchen is fed together with a flow of water through a drain hole of a sink into the shredder ring 26 of the shredder section 2 as the motor 29 rotates. The waste material in the shredder ring 26 is shredded by the action of the shredder members 24 and 25 driven by the motor 29. The shredded waste material is then transferred from the outlet opening 27b of the main cylinder 27 through the transfer conduit 28 and the casing 51 into the screen member 54 of the water remover section 3. Most water carried with the shredded waste material is discharged from the drain outlet 51b of the casing 51 to an outside drainage system.

The shredded waste material is carried from lower to upper throughout the screen member 54 by the rotation of the screw 53 while being urged the lower region 53b'' of the spiral blade 53b. As the spiral blade 53b of the screw 53 rotates, the pins 60 projecting from the outer edge of its lower region 54b'' run directly on the inner wall of the screen member 54 and scrape off such sticky portions of the shredded waste material allowing the flow of water to pass through the apertures 54c smoothly. Also, as being carried with the spiral blade 53b, the shredded waste material is prevented its rotating movement by the rib portions 54b which are arranged at equal intervals on the inner wall of the screen member 54 to project inward and extend vertically from the uppermost end to a central region of the screen member 54, and thus aggregated on the rib portions 54b. As the transfer movement of the shredded waste material continues, the shredded waste material on the rib portions 54b of the screen member 54 is further aggregated and compressed releasing its containing water which is then discharged through the apertures 54c of the screen member 54.

Accordingly, while the shredded waste material is carried upwards throughout the inside of the screen member 54 efficiently, its containing water is removed and easily drained through the waste-free apertures 54c of the screen member 54 into the casing 51 before finally discharged out from the drain outlet 51b of the casing 51. The shredded waste material with a minimum of water is then discharged from the upper opening of the screen member 54, agitated with the agitator blades 66*a* of the screw cap 66, and transferred through the waste discharging conduit 64 into an outside waste container (not shown).

As set forth above, according to the present invention, the shredded waste material can sufficiently be squeezed to release its containing water by interruption of its rotating movement with the vertically extending rib portions arranged on the inner wall of the screen member during the traveling. Hence, disposal of the shredded waste material stored in the waste container will be decreased in the number of actions and also, generation of odor derived from the stored waste material will be minimized. The apertures for draining the water removed from the shredded waste material are provided in the entire surface of the rib portions of the screen member so that the waste water can be discharged at higher efficiency. Accordingly, such a disadvantageous event that the water removed from the shredded waste material flows back to the bottom of the screen member and joins with the succeeding shredded waste material will be eliminated.

The pins made of a hard metal are provided on the outer edge of the lower region of the spiral blade of the screw so as to run directly on the inner wall of the screen member and scrape off sticky portions of the shredded waste material from the inner wall of the screen member. Accordingly, the flow of waste water passing the apertures of the screen member will be ensured and the removal of water from the shredded waste material will be increased in efficiency.

I claim:

1. A waste disposer comprising:

a shredder section communicated with a drain hole of a sink in a kitchen for shredding waste material;

a water remover section coupled integrally with the shredder for removing water from the waste material, in which the waste material is fed together with a supply of water into and shredded with the shredder section, and the shredded waste material is carried upward throughout a cylindrical screen member mounted in the water remover section by the rotation of a blade of a screw provided in the screen member while its containing water being removed and drained through apertures of the screen member before discharged from the upper end of the screen member;

said screen member having a plurality of rib portions of a given width arranged at equal intervals on the inner wall thereof; and said rib portions projecting inward and extending vertically from the upper end to a central region of the screen member so that the screw blade comes in direct contact with the rib portions during its rotation.

2. A waste disposer comprising:

a shredder section communicated with a drain hole of a sink in a kitchen for shredding waste material;

a water remover section coupled integrally with the shredder for removing water from the waste material, in which the waste material is fed together with a supply of water into and shredded with the shredder section, and the shredded waste material is carried upward throughout a cylindrical screen member mounted in the water remover section by the rotation of a blade of a screw provided in the screen member while its containing water being removed and drained through apertures of the screen member before discharged from the upper end of the screen member;

said screw blade having a plurality of pins of a hard material provided at equal intervals on the outer edge of a lower region, from the lowermost to a central, thereof; and said pins having a length sufficient to run directly on the inner wall of the screen member as the screw rotates.

* * * * *